US010669733B2

(12) United States Patent
Gollapudi et al.

(10) Patent No.: US 10,669,733 B2
(45) Date of Patent: Jun. 2, 2020

(54) EARTHQUAKE RESISTANT CONSTRUCTION ELEMENT

(71) Applicants: SAINT-GOBAIN PLACO, Suresnes (FR); Srikant Gollapudi, Chennai (IN)

(72) Inventors: Srikant Gollapudi, Chennai (IN); Aysha Kalanad, Kozhikode (IN); Suryateja Bulusu, Hyderabad (IN); Manish Kumar Sharma, Jaipur (IN)

(73) Assignee: Saint-Gobain Placo, Suresnes (FR)

( * ) Notice: Subject to any disclaimer, the term of this patent is extended or adjusted under 35 U.S.C. 154(b) by 0 days.

(21) Appl. No.: 15/772,687

(22) PCT Filed: Oct. 27, 2016

(86) PCT No.: PCT/IN2016/050366
§ 371 (c)(1),
(2) Date: May 1, 2018

(87) PCT Pub. No.: WO2017/077548
PCT Pub. Date: May 11, 2017

(65) Prior Publication Data

US 2019/0161990 A1 May 30, 2019

(30) Foreign Application Priority Data

Nov. 2, 2015 (IN) ..... 5928/CHE/2015

(51) Int. Cl.
*E04H 9/02* (2006.01)
*E04B 2/58* (2006.01)

(52) U.S. Cl.
CPC ..... *E04H 9/021* (2013.01); *E04B 2/58* (2013.01)

(58) Field of Classification Search
CPC ..... E04H 9/021; E04B 2/58
See application file for complete search history.

(56) References Cited

U.S. PATENT DOCUMENTS 2,683,927 A * 7/1954 Maronek ..... B21D 5/01 29/521
5,113,631 A 5/1992 diGirolamo
5,913,788 A * 6/1999 Herren ..... E04B 2/825 52/236.7

(Continued)

FOREIGN PATENT DOCUMENTS

JP H10-292597 A 11/1998
JP 2013-181285 A 9/2013
WO 2014039278 A2 3/2014

OTHER PUBLICATIONS

International Search Report and Written Opinion in International Patent Application PCT/IN2016/050366, dated Feb. 23, 2017.

*Primary Examiner* — Adriana Figueroa
(74) *Attorney, Agent, or Firm* — McDonnell Boehnen Hulbert & Berghoff LLP

(57) ABSTRACT

An earthquake resistant wall construction is described. The earthquake resistant wall construction comprises a first runner, a second runner, at least one first earthquake resistant insert in communication with the first runner or second runner. The earthquake resistant insert is connected to a construction board and comprises at least one first elongate slot, wherein the earthquake resistant insert is held in communication with said first runner or second runner via at least one first fixing member which passes through the first elongate slot.

19 Claims, 10 Drawing Sheets

(56) References Cited

U.S. PATENT DOCUMENTS

| | | | | |
|---|---|---|---|---|
| 7,299,593 | B1 * | 11/2007 | diGirolamo | E04B 2/58 52/241 |
| 7,966,778 | B2 * | 6/2011 | Klein | E04B 2/825 52/126.3 |
| 8,387,321 | B2 * | 3/2013 | diGirolamo | E04B 2/58 52/241 |
| 8,413,394 | B2 * | 4/2013 | Pilz | E04B 2/7411 52/207 |
| 8,499,512 | B2 * | 8/2013 | Pilz | E04B 1/24 52/235 |
| 8,555,566 | B2 * | 10/2013 | Pilz | E04B 2/828 52/167.1 |
| 8,769,887 | B2 * | 7/2014 | Proffitt, Jr. | E04B 2/58 52/167.3 |
| 8,973,319 | B2 * | 3/2015 | Pilz | E04B 2/828 52/232 |
| 9,290,934 | B2 * | 3/2016 | Pilz | E04B 2/828 |
| 2006/0032157 | A1 * | 2/2006 | Baryla | E04B 2/7457 52/167.1 |
| 2007/0107325 | A1 | 5/2007 | Placoplatre | |

* cited by examiner

EARTHQUAKE RESISTANT CONSTRUCTION ELEMENT

CROSS-REFERENCE TO RELATED APPLICATIONS

This application is a U.S. national phase application of International Patent Application no. PCT/IN2016/050366, filed Oct. 27, 2016, which claims the benefit of priority of Indian Patent Application no. 5928/CHE/2015 filed Nov. 2, 2015.

TECHNICAL FIELD

The present invention relates to an earthquake resistant construction element; in particular to an earthquake resistant wall construction comprising an earthquake resistant insert that allows a construction board to move within runners.

BACKGROUND

During an earthquake, it is important for a building to be able to withstand the movement of its foundations such that it protects both its inhabitants from injury and reduces the structural and superficial damage to the building to a minimum. Whilst progress has been made on increasing the integrity of the loadbearing components of a building during an earthquake, there has been less focus on the non-loadbearing components of the building. Whilst these non-loadbearing components of the building are less essential to the overall stability of the building, their integrity both during and after an earthquake event remains an important consideration.

During an earthquake, the structural integrity of non-loadbearing components of the building such as partition walls and ceilings is of great concern, as debris from any damage to these components may fall and injure the occupants of the building. Additionally, the resilience of these components is also a major concern as any large scale damage may result in a building becoming unusable for a period of time, even if the structure of the building remains stable, slowing the recovery from an earthquake event. As such, ensuring the resilience of the non-loadbearing components of a building both during and after an earthquake is an important problem to which no satisfactory solutions have been provided.

For reference, US patent publication number 20060032157 relates to a ceiling runner/upper runner that is specially designed for allowing movement of the ceiling relative to the floor without damaging the wall. The wall system includes a ceiling runner, a floor runner and studs that are mounted between the ceiling runner and the floor runner. The ceiling runner is loosely attached to the ceiling with fasteners and the floor runner is attached to the floor with fasteners. The ceiling runner defines multiple slots. The studs are placed in slots in the ceiling runner and are not rigidly connected with a fastener or a weld. The studs move within the slots thereby accommodating horizontal movement of the ceiling relative to the floor. The horizontal ceiling movement causes the fasteners to slide within the slots in the web of the ceiling runner.

However, this prior art reference does not disclose any mechanism to facilitate horizontal movement of the board. Thus, there is a need for a device or a system that facilitates horizontal movement of the board without damage thereof during seismic conditions without changing the existing upper and lower runners.

SUMMARY OF THE DISCLOSURE

In one aspect of the present disclosure, an earthquake resistant wall construction is disclosed. The earthquake resistant wall construction comprises a first runner, a second runner and at least one earthquake resistant insert in communication with the first runner or the second runner and connected to at least one construction board. The earthquake resistant insert further comprises at least one elongate slot. The earthquake resistant insert is held in communication with the first or second runner via at least one first fixing member that passes through the elongate slot. The earthquake resistant insert is connected to the construction board on either side of the earthquake resistant insert using at least one second fixing member.

In another aspect of the present disclosure, an earthquake resistant insert comprising a first leg, second leg and a base is disclosed. The first leg and second leg of the earthquake resistant insert extend perpendicularly from the base. The base further comprises at least one elongate slot for accommodating at least one first fixing member.

In yet another aspect of the present disclosure, a method of constructing an earthquake resistant wall is disclosed. The method comprises the steps of providing a first runner and a second runner, fixing the first and second runner to an adjacent surface using at least one third fixing member, sliding one or more studs to the runners by placing one end of the stud into the first runner and the other end of the stud into the second runner, placing an earthquake resistant insert between the studs in the first runner and/or the second runner, fixing the earthquake resistant insert to the first and second runner through the first fixing member and attaching a construction board on either side of the earthquake resistant insert via at least one second fixing member.

Other features and aspects of this disclosure will be apparent from the following description and the accompanying drawings.

BRIEF DESCRIPTION OF THE DRAWINGS

Embodiments are illustrated by way of example and are not limited in the accompanying figures.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

An earthquake resistant wall construction comprising earthquake resistant inserts placed in runners is disclosed. Such a construction is advantageous as it enables the construction of earthquake resistant walls, ceilings and other building elements without necessitating the installation of specialized runners. The earthquake resistant insert further comprises one or more elongate slots. The earthquake resistant inserts of the present invention move in relation to the runners, facilitated by the elongate slots, thus providing the construction walls with earthquake resistance. The connection between the runners and the adjacent surface of the building is not required to be mobile and traditional runners or channels can be used. Such a feature is advantageous as the cost of installation of the construction element may be lowered with increased installation ease.

Additionally, the movement of the earthquake resistant wall construction being controlled by the movement of the earthquake resistant insert relative to the runners may be advantageous as, in such an embodiment, said movement is governed by the length of the elongate slot and the friction between the runner and the earthquake resistant insert. In this embodiment of the invention, the earthquake resistant insert and the runners are constructed from materials selected by the user and therefore the degree of friction between the two can be chosen to be within user defined parameters. This may not be the case in other systems, where the earthquake resistant construction moves relative to or slides against a preinstalled component, for example a concrete structure of the building.

In one embodiment, the earthquake resistant wall is non-loadbearing. Such an embodiment of the invention may be preferable as it may allow the construction of internal walls, ceilings, and other space dividing construction elements.

Figure 1:
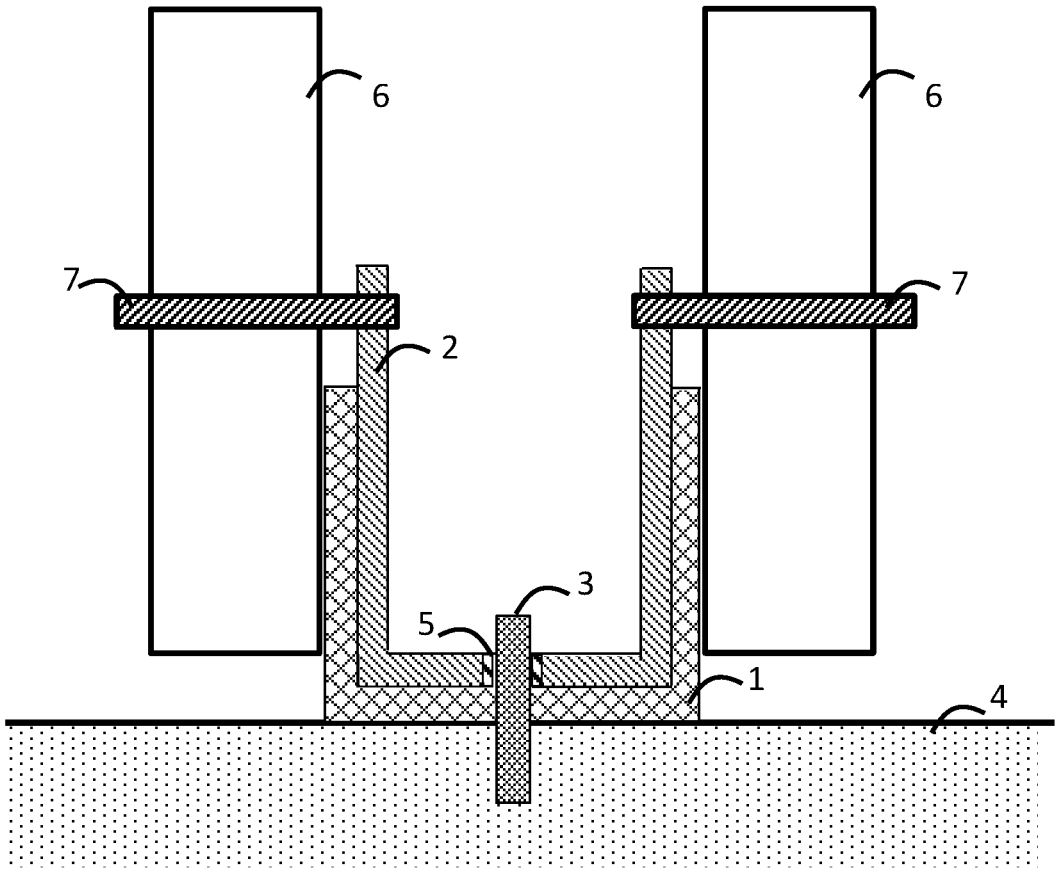
FIG. 1 illustrates a schematic of an earthquake resistant insert connected to a construction board in a runner, according to an embodiment of the present disclosure.

Wherever possible, the same reference numbers will be used throughout the drawings to refer to the same or the like parts. FIG. 1 illustrates an exemplary runner 1 and an exemplary earthquake resistant insert 2. In this embodiment of the invention, the earthquake resistant insert 2 is located inside the runner 1 via a first fixing member 3. The first fixing member 3 further anchors or holds the runner 1 in position with respect to the adjacent surface 4, most commonly a ceiling or floor. In this embodiment of the invention, the earthquake resistant insert 2 is a U shaped member, and is sized to fit inside the runner 1. The U shaped earthquake resistant insert 2 may move well within a runner 1, whilst offering surfaces to which the construction board may be easily connected.

The first fixing member 3 used to locate or position the earthquake resistant insert 2 inside the runner 1 is inserted through an elongate slot 5 in the earthquake resistant insert 2. The elongate slot 5 lies substantially parallel to the longitudinal length of the runner 1. The use of an elongate slot 5 in the earthquake resistant insert 2 allows the movement of the earthquake resistant insert 2 along the longitudinal length of the runner 1 in response to the movements associated with an earthquake event. The degree of travel which an earthquake resistant insert 2 may experience along the longitudinal length of the runner 1 may therefore be limited by the length of the elongate slot 5. In the embodiment of the invention depicted in FIG. 1, the elongate slot 5 has a length of 60 mm, although lengths between at least 20 and 100 mm are envisaged.

Additionally, FIG. 1 depicts the fixation or attachment of a construction board 6, in this embodiment a plasterboard panel, to the earthquake resistant insert 2 via a second fixing member 7. In this embodiment of the invention, the second fixing member 7 attaches the construction board 6 to the earthquake resistant insert 2, holding the construction board 6 in place relative to the earthquake resistant insert 2, on the outside of the runner 1. Therefore, in this embodiment, the construction board 6 is not held in a fixed position relative to the runner 1, and instead may move longitudinally along the length of the runner 1 concomitant with the movement of the earthquake resistant insert 2. Such an embodiment of the invention may be advantageous as a second fixing member 7 may provide a secure connection between the construction board 6 and the earthquake resistant insert 2, required to prevent damage to the earthquake resistant construction element during an earthquake event.

In one embodiments of the invention, the earthquake resistant insert 2 may preferably be located substantially within the runner 1. In one other embodiment, the earthquake resistant insert 2 extends above the runner 1. Such an embodiment may be preferable as the ability of the earthquake resistant insert 2 to move within the runner 1 may be substantially controlled by the friction between the earthquake resistant insert 2 and the runner 1. This material parameter may be controlled or chosen by the user upon installation of the earthquake resistant wall construction, and therefore may allow customization over the strength of an earthquake event which is required to cause the movement of the earthquake resistant insert 2 relative to the runner 1. Such an embodiment may also be preferable as it may prevent differences in the material or finish of any adjacent surface influencing the mobility of the earthquake resistant construction system in specific areas.

In this embodiment of the invention, the first fixing member 3 is a screw although bolts and the use of other fixing methods are also envisaged. Here, the elongate slot 5 is wider than the first fixing member 3, but the head of the screw which forms the first fixing member 3 is wider than the elongate slot 5. In this way, the earthquake resistant insert 2 may travel longitudinally along the length of the runner 1, within the limits of the elongate slot 5, but is held by the head of the screw which forms the first fixing member 3 in communication with the runner 1.

In one embodiment, the second fixing member 7 may comprise a screw. In one other embodiment, the second fixing member 7 may comprise a bolt. In another embodiment, the second fixing member 7 may comprise a nail. In yet another embodiment, the construction board 6 may be connected to the earthquake resistant insert 2 using an adhesive or glue.

In the arrangement of the present disclosure, the construction board 6 is movable connected to the runner 1, potentially increasing the resilience of the construction element without reducing its ability to move with the earth movements associated with an earthquake event. Additionally, the use of earthquake resistant inserts 2 in communication with a ceiling may allow increased control over the movement of the earthquake resistant construction system; this movement may now be additionally controlled by the length of the elongate slot 5 and the degree of friction between the earthquake resistant insert and ceiling.

Figure 2:
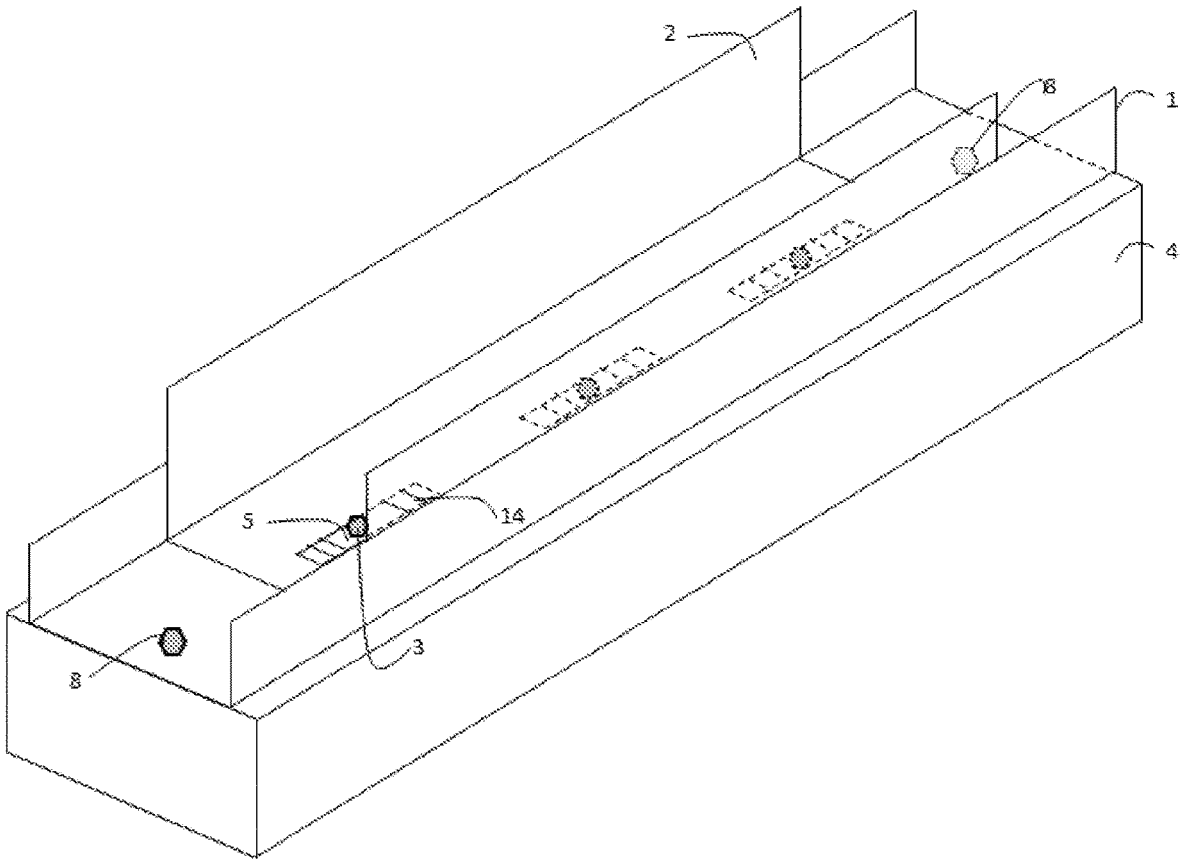
FIG. 2 illustrates a schematic of an earthquake resistant insert placed in a runner, according to an embodiment of the present disclosure.

FIG. 2 illustrates the connection of an earthquake resistant insert 2 to a runner 1 in greater detail. FIG. 2 depicts runner 1, the earthquake resistant insert 2, the first fixing member 3, the adjacent surface 4 and the elongate slots 5 of FIG. 1, and also depicts the use of a third fixing member 8. The third fixing member 8 is used to fix the runner 1 in place with respect to the adjacent surface 4, differing from the first fixing member 3 in that the third fixing member 8 is not inserted through an elongate slot 5 in an earthquake resistant insert 2. As such, the third fixing member 8 is not associated with the movement of the earthquake resistant insert 2 or the construction board 6 and provides firm fixation between the runner 1 and the adjacent surface 4.

Figure 4:
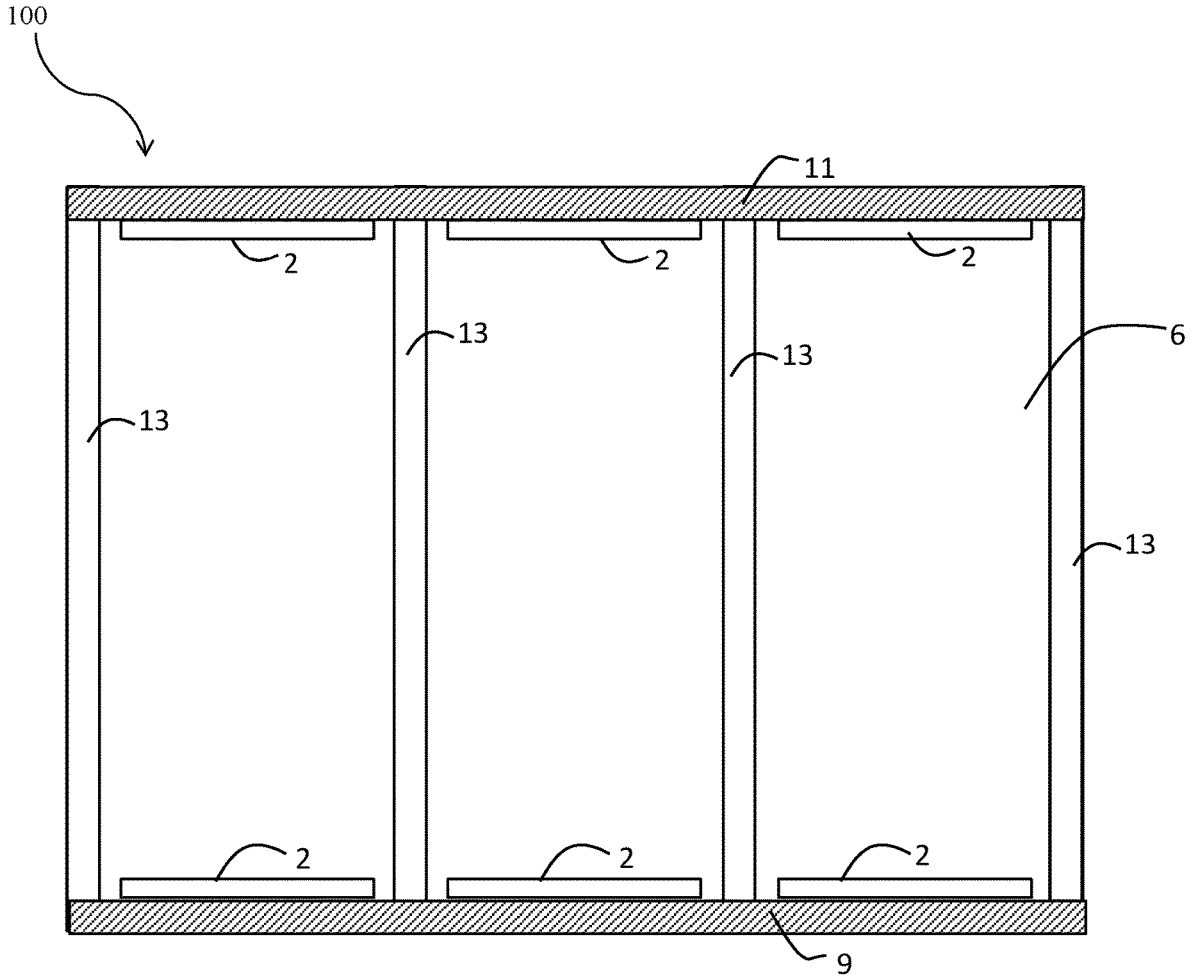
FIG. 4 illustrates an earthquake resistant non-loadbearing wall, according to an embodiment of the present disclosure.

In this embodiment of the invention the third fixing member 8 are screws, although bolts, anchor blocks and other means of fixation, either separately or in combination, are also envisaged as alternatives. In one other embodiment, the third fixing member 8 may be located proximal to the end of the runners. In another embodiment, the third fixing member 8 may be located at the ends of a first runner 9 and a second runner 11 as shown in FIG. 4. Such an embodiment may be preferable as the third fixing member 8 may be prone to failure during an earthquake event by potentially lifting away or becoming detached from the adjacent surface.

In still another embodiment, the third fixing member 8 may be regularly spaced along the length of the first runner 9 and the second runner 11. Such an embodiment may be preferable as it may ensure the first runner 9 and the second runner 11 are securely attached to an adjacent surface along substantially its length.

In one embodiment, the runner 1 is constructed from a material which can be described as textured, dimpled or ridged. In one other embodiment, the runner 1 is a metal channel. In one other embodiment, the runner 1 is a wood channel. In one other embodiment, the runner 1 is a plastic channel. Preferably the channels comprise U shaped cross sections. In yet another embodiment, the U shaped sections are metal.

In one embodiment, the earthquake resistant insert 2 is made from a metal. In one specific embodiment, the earthquake resistant insert 2 is made of steel as it is a low cost material that could be easily worked with. Additionally, steel earthquake resistant inserts 2 may have a smooth, low friction surface which can easily move within the runner 1, enabling the earthquake resistant construction system to resist damage during an earthquake event.

In one another embodiment, the earthquake resistant insert 2 may comprise a textured surface. The textured surface may increase the strength of the earthquake resistant insert 2, providing the earthquake resistant wall construction with increased resistance to damage during an earthquake event. The textured surface may also provide the earthquake resistant insert 2 with additional rigidity such that the construction board 6 may be more easily affixed to the earthquake resistant insert 2 using the first fixing members 3.

The textured surface may comprise any one of, or a combination of ribs, troughs, indents, undulations or dimples. In one embodiment, the textures may be introduced onto the surface of the earthquake resistant insert 2 during the forming of the insert. In one other embodiment, the textures may be machined onto the surface of the earthquake resistant insert 2 after its formation.

In one embodiment, the elongate slot 5 lies substantially parallel to the longitudinal length of the runner 1. In one other embodiment, the elongate slot 5 may have a width greater than the diameter of the first fixing member 3. In one other embodiment, the elongate slot 5 may have a width at least 1 mm greater than the diameter of the first fixing member 3. In alternative embodiments, the elongate slot 5 may have a width of at least 3 mm, or at least 5 mm, greater than the diameter of the first fixing member 3. The use of an elongate slot 5 with a width greater than the diameter of the first fixing member 3 may be preferable as it may reduce any resistance to the movement of the earthquake resistant insert 2, and the attached construction board 6, during the earth movements associated with an earthquake event.

In one other embodiment, the elongate slot 5 may have a length between 20 and 100 mm. In one other embodiment, the elongate slot 5 may have a length of 60 mm. In one other embodiment, the elongate slot 5 may have a length between 40 and 80 mm. The use of such lengths may be preferable as they allow the earthquake resistant wall construction sufficient mobility such that it may resist damage during the earth movements associated with an earthquake event. Preferably, the length of the elongate slot 5 may be chosen to correspond to the allowable inter-storey displacement of the building into which the earthquake resistant wall construction is inserted.

In some embodiments of the invention, the elongate slot 5 may comprise at least one resistant member 14 (shown in FIG. 5A to 5E). In such an embodiment of the invention, the inclusion of at least one resistant member 14 in the elongate slot 5 may provide an additional level of control over the extent to which the earthquake resistant insert 2 may move relative to the runner 1 during any specific earthquake event. As such, the response of the earthquake resistant wall construction may be tailored to be appropriate to the severity of any earthquake event. In one embodiment, the resistant member 14 may be located substantially perpendicular to the long axis of the elongate slot 5. In one other embodiment, the resistant member 14 may comprise a strip of resistant material which extends across the elongate slot 5. In one other embodiment, the resistant member 14 may comprise a shaped edge of the elongate slot 5. In still another embodiment, the resistant member 14 may comprise at least one indent 15 along the length of the elongate slot 5.

Figure 3:
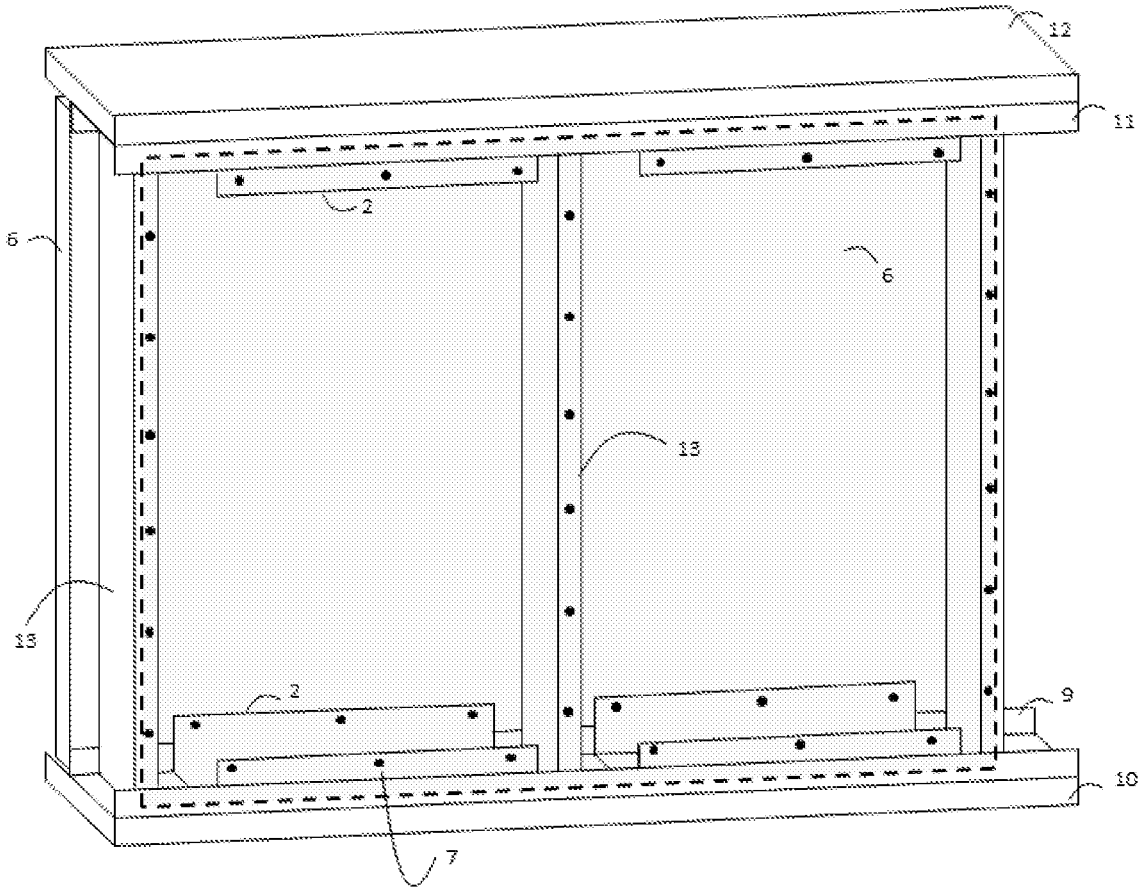
FIG. 3 illustrates a schematic of connecting a plurality of earthquake resistant inserts to a construction board, according to an embodiment of the present disclosure.

FIG. 3 depicts a partially assembled wall construction. In FIG. 3, a first runner 9 is connected to a floor surface 10, and a second runner 11 is connected to a ceiling surface 12.

Earthquake resistant inserts 2 are located as illustrated in FIG. 2 in each of the first runner 9 and second runner 11, and each earthquake resistant insert 2 is connected to the construction board 6 via a plurality of second fixing members 7. In this embodiment of the invention, the construction board 6 is held firmly between two surfaces 10 and 12, but may move longitudinally along the first and second runners 9 and 11 in response to the movements associated with an earthquake event.

In one embodiment, the first runner 9 and second runner 11 are substantially opposite one another. Such an embodiment may be preferable as it may ease the construction of earthquake resistant walls and ceilings. In one another embodiment, the edge of the construction board 6 is located substantially outside the first runner 9 or the second runner 11. In such an embodiment, the construction board 6 may mask the first runner 9 and the second runner 11, such that the construction board 6 may abut adjacent surfaces. In this case, the aesthetics of the earthquake resistant wall construction may be improved, and the integration of the earthquake resistant insert 2 within an interior design plan be more easily achieved.

In one embodiment, it may be preferable for the earthquake resistant wall construction to further comprise at least one strut 13 connected to the construction board 6. Such an embodiment may be preferable as it may allow the construction of larger walls, ceilings or other building elements using earthquake resistant wall construction connected by struts 13.

In some embodiments of the invention, it may be preferable for an end of said strut 13 to be located substantially with said first runner 9 or said second runner 11. In such an embodiment of the invention, the strut 13 may move freely with the construction board 6 in response to an earthquake event, potentially reducing any damage to the earthquake resistant wall construction. Such an embodiment may also be advantageous as the friction between the end of the strut 13 and the first runner 9 or second runner 11 may be controlled by the user via the choice of materials for both the strut 13 and the runners 9 and 11. In another embodiment, the strut 13 may have no fixed connection to the runner. In yet another embodiment, the strut 13 is a wall stud.

In one embodiment, the construction board 6 may be a gypsum panel with a high weight percentage of both glass fiber and starch. In another embodiment, the construction board 6 may be a cementitious or wood based board, although the use of other materials is also envisaged. Cementitious boards include, but are not limited to, those which comprise gypsum, Portland cement, calcium aluminate, magnesium oxychloride, magnesium phosphate, and mixtures thereof.

It is also envisaged that the gypsum based boards may be of plasterboard type construction and may be faced with paper, glass fiber or other liners. Additionally, the gypsum based construction boards may be of a gypsum fiber, or similar, construction. In one other embodiment, the construction board 6 may comprise fiber cement. Such an embodiment of the invention may be preferable as the construction boards are readily available and may be formed into many shapes to provide walls, ceilings and other space dividing constructional elements in many forms.

In one other embodiment, the construction board 6 may be reinforced. Such an embodiment of the invention may be preferable as the racking resistance of the construction board may be improved. In yet another embodiment, the construction board 6 may comprise a polymeric binder and a plurality of fibres. Such a feature may be preferable as it may provide reinforcement to the construction board. Preferably, said plurality of fibres may comprise glass fibres, synthetic polymer fibres or natural fibres, either separately or in combination.

In one other embodiment, said polymeric binder and said plurality of fibres, in combination, comprise greater than 1% by weight of the construction board 6. Such an embodiment of the invention may be preferable as it may increase the strength of the construction board 6. Preferably, the polymeric binder may comprise greater than 1% by weight of the construction board 6. Preferably, the fibres may comprise greater than 1% by weight of the construction board 6. In one embodiment, the polymeric binder may comprise starch. In one other embodiment, the polymeric binder may comprise synthetic material not limiting to polyvinyl acetate. In yet another embodiment, the construction board 6 may comprise a Habito (registered trade mark) board.

FIG. 4 schematically illustrates an earthquake resistant, non-loadbearing wall 100. In this embodiment of the invention, the construction board 6, held in place with earthquake resistant inserts 2 located inside the first runner 9 and the second runner 11 are connected with studs 13. As such, the construction boards 6 which form the non-loadbearing wall 100 depicted in FIG. 4 may move together in response to an earthquake event, held in position relative to one another by the studs 13. The construction boards 6 may move together, longitudinally along the runner, as in this embodiment of the invention the construction boards 6 are located within the first runner 9 and second runner 11 via the use of earthquake resistant inserts 2 and first fixing members 3. In this embodiment of the invention, a wall 100 with both sufficient stability to support items such as televisions and computer screens and sufficient mobility to resist damage during an earthquake is provided.

Figure 5A:
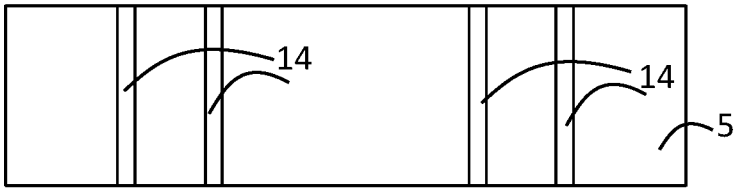
FIG. 5A illustrates an elongate slot with resistant members as contained in the earthquake resistant insert, according to an embodiment of the present disclosure.

FIG. 5A to FIG. 5E schematically illustrate various embodiments of the elongate slot of the earthquake resistant insert 2. In one embodiment of the elongate slot 5, resistant members 14 are located generally perpendicularly to the long axis of the elongate slot 5 as shown in FIG. 5A. These resistant members 14 provide a resistance or hindrance to the movement of the first fixing member 3 within the elongate slot 5, such that the earthquake resistant insert 2 only moves relative to the runner 1 in response to large movements of the surrounding structure, such as those associated with an earthquake event.

Figure 5B:
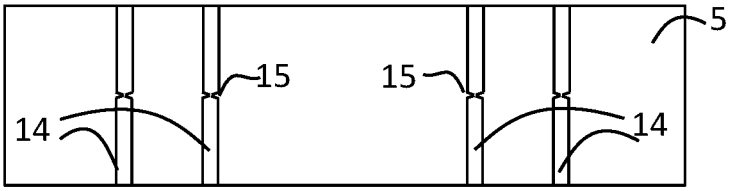
FIG. 5B illustrates an elongate slot with resistant members as contained in the earthquake resistant insert, according to another embodiment of the present disclosure.

In one other embodiment of the invention depicted in FIG. 5B, the resistant members 14 include a central indent 15, whereabouts the resistant member 14 is weakened such that it may break or deform if the movement of the earthquake resistant insert 2 relative to the runner 1 is caused by the earth movements associated with an earthquake event.

Figure 5C:
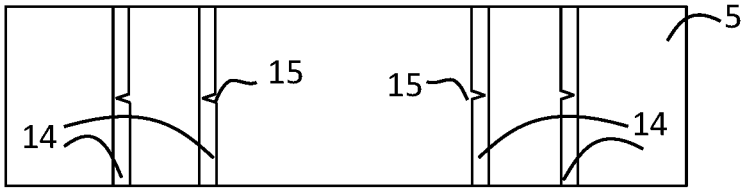
FIG. 5C illustrates an elongate slot with resistant members as contained in the earthquake resistant insert, according to another embodiment of the present disclosure.

In one other embodiment of the invention depicted in FIG. 5C, the resistant members 14 include a central indent 15 in a direction towards the first fixing member 3, whereabouts the resistant member 14 is weakened such that it may break or deform if the movement of the earthquake resistant insert 2 relative to the runner 1 is caused by the earth movements associated with an earthquake event.

Figure 5D:
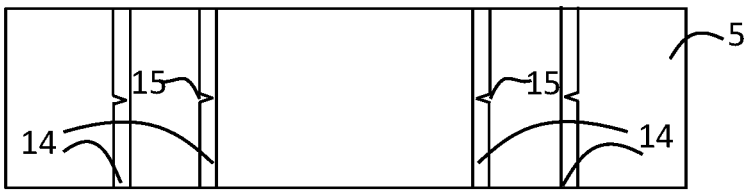
FIG. 5D illustrates an elongate slot with resistant members as contained in the earthquake resistant insert, according to another embodiment of the present disclosure.

In one other embodiment of the invention depicted in FIG. 5D, the resistant members 14 include a central indent 15 in a direction opposite to the first fixing member 3, whereabouts the resistant member 14 is weakened such that it may break or deform if the movement of the earthquake resistant insert 2 relative to the runner 1 is caused by the earth movements associated with an earthquake event.

Figure 5E:
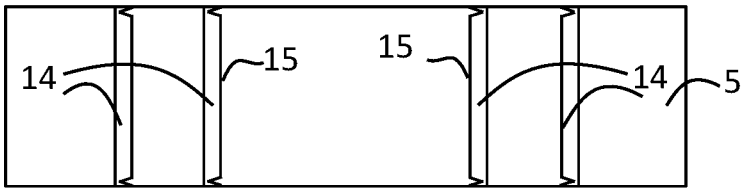
FIG. 5E illustrates an elongate slot with resistant members as contained in the earthquake resistant insert, according to another embodiment of the present disclosure.

In one other embodiment of the invention depicted in FIG. 5E, the resistant members 14 include an indent 15 towards the edges of the resistant members 14, whereabouts the resistant member 14 is weakened such that it may break or deform if the movement of the earthquake resistant insert 2 relative to the runner 1 is caused by the earth movements associated with an earthquake event.

Once the resistant member 14 is broken or deformed, the first fixing member 3 may move past the position of the resistant member 14, allowing the earthquake resistant insert 2 a greater range of motion within the runner 1.

In various embodiments of the invention, the resistant member 14 comprises steel. Additionally, in these embodiments, the resistant member 14 forms a continuous, single piece section, with the earthquake resistant insert 2.

Simulation and numerical analysis were performed to understand the deformation behavior of the earthquake resistant insert and the effect of resistant members 14 with or without the indent 15 under bolt movement. The earthquake resistant insert 2 was clamped to a concrete wall channel through the first fixing member 3 provided in the earthquake resistant insert 2. A gypsum board was attached to the earthquake resistant insert 2 by using two second fixing members 7. During the vibration, the earthquake resistant insert 2 allows the gypsum board to move in a uni-directional arrangement by allowing the first fixing member to move in the earthquake resistant insert 2.

Figure 6:
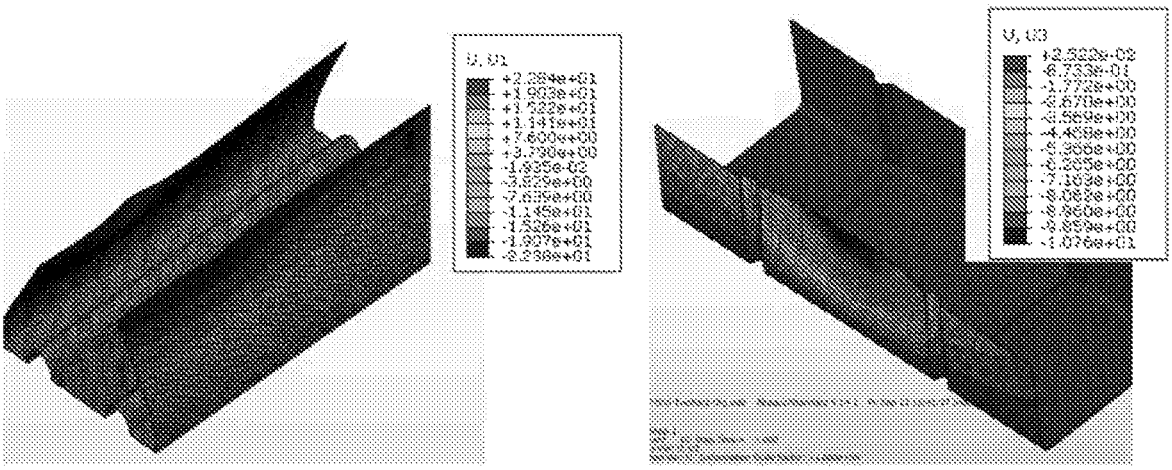
FIG. 6 illustrates the simulation results of an earthquake resistant insert with and without resistant members contained in the elongate slot, according to an embodiment of the present disclosure.

Finite element analysis on the earthquake resistant insert 2 was defined by deflection analysis of the earthquake resistant insert 2 and the effect of the resistant member 14 on plastic deformation behavior of the earthquake resistant insert 2. Deflection analysis of the earthquake resistant insert 2 was performed to evaluate if the provision of resistant members 14 in the elongate slot 5 could reduce deflection in the earthquake resistant insert 2 during screwing. It was found that the installation of construction boards 6 onto the earthquake resistant insert 2 resulted in bending of the first and second legs of the earthquake resistant insert 2. Hence to reduce the bending, resistant members 14 were introduced into the elongate slot 5 of the earthquake resistant insert 2. Simulation results of an earthquake resistant insert 2 with resistant members 14 and without resistant members 14 is depicted in FIG. 6. The inward displacement of the first and second legs of the earthquake resistant insert 2 was seen to be reduced in the presence of resistant members 14.

The resistant members 14 work as an obstacle for the movement of the first fixing member 3. The following simulations were done to understand the effect of providing resistant members 14 with indent 15 at different locations along the length of the resistant member 14.

Resistant member 14 analysis without indent 15

Resistant member 14 analysis with indent 15 at corners of the resistant member 14 (side of earthquake resistant insert)

Resistant member 14 analysis with indent 15 at center of resistant member 14 (side of earthquake resistant insert)

Resistant member 14 analysis with indent 15 at center of resistant member 14 (opposite side of resistant member)

Resistant member 14 analysis with indent 15 at center of resistant member 14 (both sides)

Figure 7:
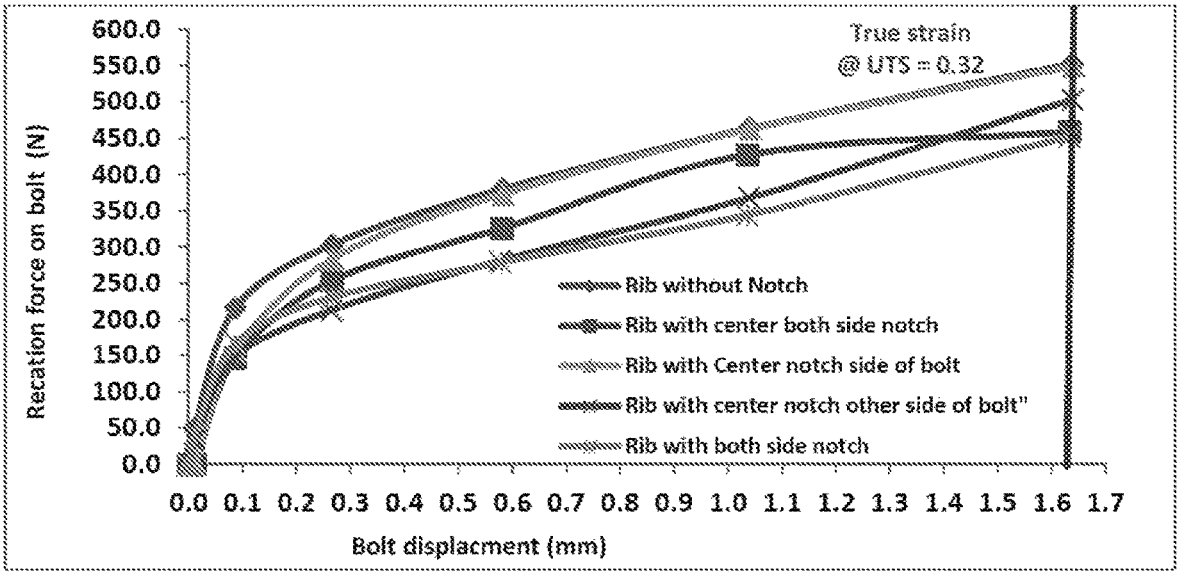
FIG. 7 illustrates simulation results of resistant members contained in the elongate slot with indent at different locations according to an embodiment of the present disclosure.

The simulation results of resistant members 14 with the indent 15 at different locations have been shown in FIG. 7. The results showed that the resistant member 14 with central indents 15 at both sides provides better results when compared to all other locations. The graph shows the simulated results of the force vs displacement for all the different locations of the indent 15.

Figure 8:
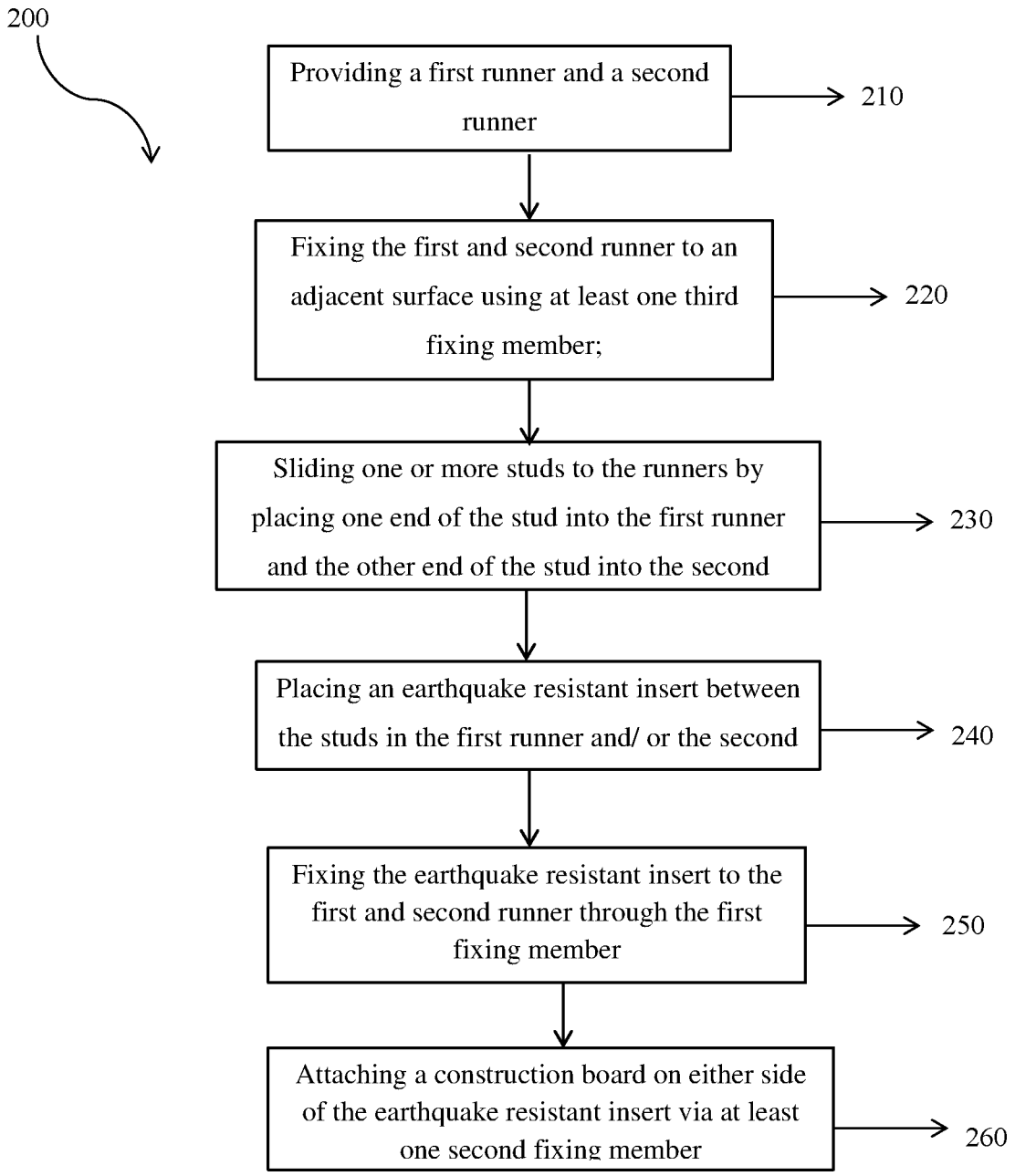
FIG. 8 illustrates a flowchart for constructing an earthquake resistant wall, according to an embodiment of the present disclosure.

Referring to FIG. 8, a flowchart for a method 200 of constructing an earthquake resistant wall is illustrated. In an embodiment, the earthquake resistant wall of FIG. 3 and FIG. 4 may be formed by implementing steps 210 to 260 of the method 200. However, it may also be contemplated to implement the method 200 with other suitable tools without deviating from the scope of the present disclosure.

At step 210, the first runner 9 and second runner 11 are provided adjacent to a surface. In one embodiment the first runner 9 and second runner 11 are provided adjacent to a wall and a ceiling surface, respectively. In one other embodiment, the first runner 9 and second runner 11 may be provided opposite to each other in a horizontal plane.

At step 220, the first runner 9 and second runner 11 are fixed to the adjacent surface using a third fixing member.

At step 230, one or more studs are slid along the length of the first runner 9 and second runner 11 by placing one end of the stud into the first runner 9 and the other end of the stud into the second runner 11. In one embodiment, the number of stud depends on the length of the construction wall.

At step 240, an earthquake resistant insert 2 is placed between the studs in the first runner 9 and the second runner 11. In one embodiment, the number of earthquake resistant insert 2 depends on the number of studs placed in the runners. In one other embodiment, the earthquake resistant inserts 2 alternate with the studs in the runners.

At step 250, the earthquake resistant insert 2 is fixed to the first runner 9 and second runner 11 through a first fixing member 3.

At step 260, a construction board 6 is attached on either side of the earthquake resistant insert 2 via at least one second fixing member 7.

In one embodiment, the construction boards 6 are not held in a fixed position relative to the first runner 9 and second runner 11. In one other embodiment, the construction boards 6 move longitudinally along the length of the first runner 9 and second runner 11 concomitant with the movement of the earthquake resistant insert 2 during an earthquake event.

EXAMPLE 1

Seismic Testing of Earthquake Resistant Wall: Full-scale Test Set-up

An earthquake resistant wall was constructed as per the method of the current invention. The earthquake resistant wall comprises earthquake resistant inserts fixed in the runners and construction boards fixed to the earthquake resistant inserts.

The tested wall was approximately 2.4 m tall and 4.8 m long. This wall was installed over a concrete reaction beam of dimension 0.2×0.2×2.5 m. A loading beam/spreader beam was provided on top of the wall, to allow for application of uniform shear. This spreader beam was made of two ISMC 150 channels [5] at 100 mm clear spacing, between which concrete blocks were fixed in order to simulate conditions similar to actual site conditions. The top track of wall panel was attached to the spreader beam and the bottom track to the reaction beam by 8 mm ΦHilti bolts (Sleeve Anchor HLC 8×40/10).

To restrain the lateral out of plane movement of the wall at the top, two tee brackets with 20 mm thick plate were inserted in the 22 mm gap between the two ISMC in the spreader beam. The Tee bracket was connected to the web of an ISMB 250 [5] beam at the top of the loading frame, which in turn was connected to the face of the vertical members of the reaction frame. In order to avoid bearing of board edges on the flanges of the reaction and spreader beam, and to allow free movement of the boards, a gap of 10 mm was ensured between the board and the beams at top and bottom of the loading frame. The spreader beam was connected to the actuator. The in-plane shear load was applied through spreader beam using the programmable servo-hydraulic actuator (MTS System Corporation). The load carrying capacity of the actuator was 350 kN with the displacement range of +/−250 mm.

Linear Variable differential transformers (LVDT) were used to measure the vertical and horizontal displacements. All the LVDTs were connected to a data-logger for automatic data acquisition at a predefined rate.

All the experiments were conducted in the displacement control mode only. With the displacement as an input, the load was measured through the actuator load cells simultaneously using the MTS data acquisition system. To synchronize the LVDT readings in the specimen with the actuator input displacement and load, a reference load cell was placed at the top of the actuator ram.

ASTM standards (ASTM E564 [6] for monotonic tests & ASTM E 2126 [7] for cyclic tests) for seismic testing of wall elements was followed for this test. This standard covers three loading protocols for the evaluation of the shear stiffness, shear strength, and ductility of the vertical elements of lateral force resisting systems, including applicable shear connections and hold-down connections, under quasi-static cyclic (reversed) load conditions. Earthquakes being random vibrations, there was no unique cyclic displacement or loading history which can perfectly replicate the actual loading. These loading protocols were intended to produce data that sufficiently describe elastic and inelastic cyclic properties; and the typical failure mode that was expected in earthquake loading.

Figure 9:
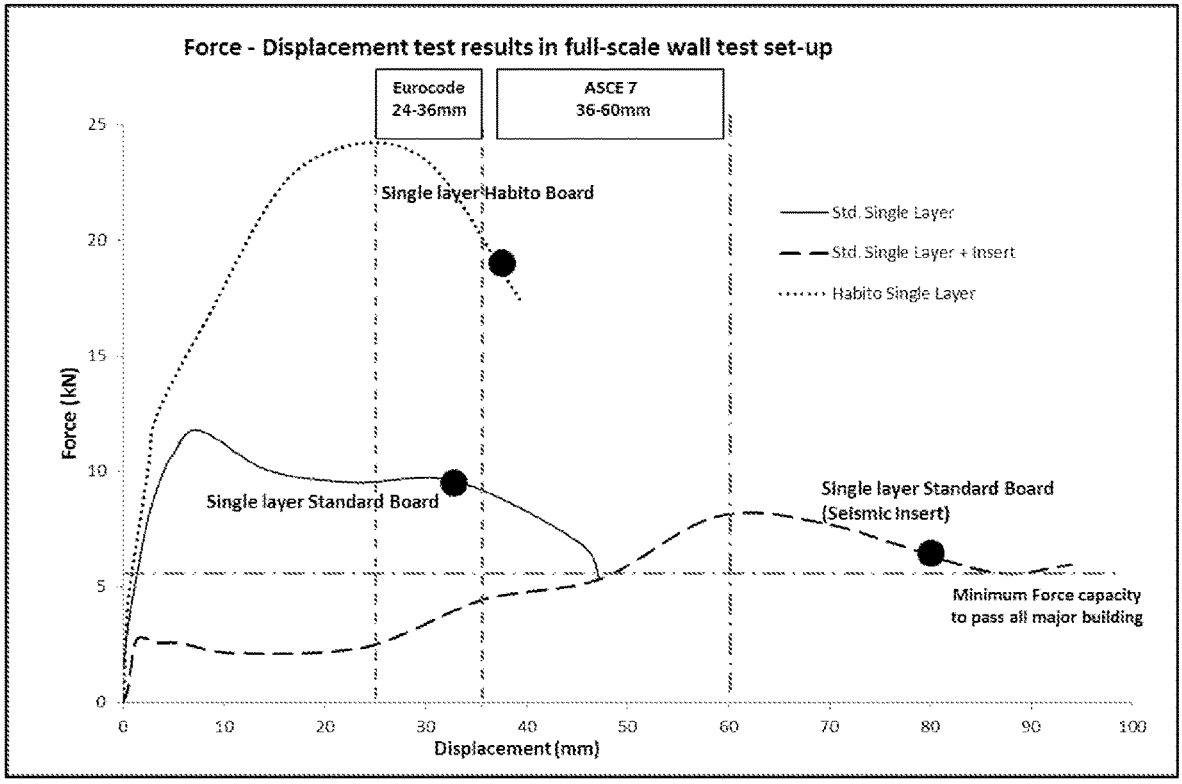
FIG. 9 illustrates a graph showing force vs displacement of a standard plasterboard, a standard plasterboard incorporated with earthquake resistant insert and a Habito board in a full-scale test set-up, according to an embodiment of the present disclosure.

FIG. 9 provides the graphical representation of the seismic testing results. The results of a wall made of standard plasterboard, single layer; standard plasterboard, single layer with earthquake resistant inserts; and Habito board, single layer are provided. The results are also tabulated in Table. 1

TABLE 1

Results of Seismic Testing of Construction Boards - Full Scale Set-up

| | Sample | | |
|---|---|---|---|
| Parameters | Standard plasterboard, single layer | Standard plasterboard, single layer with earthquake resistant insert | Habito board, single layer |
| Force (kN) | 10 | 8 | 20 |
| Displacement (mm) | 32 | 80 | 37 |

FIG. 9 further illustrates a horizontal line on the plot at ~6 kN indicating the minimum force capacity for the test wall (2.4 m×4.8 m, weight ~250 kg) to pass the force requirement of all the major standard building code requirements such as. The displacement requirement was more varied for the different building codes, i.e. for the Eurocode, the required displacement capacity was 24-36 mm, and for the American code, ASCE the requirement was 36-60 mm. For a global wall system that has full code compliance, the strength of the wall should exceed 6 kN and the displacement capacity should exceed 60 mm.

Standard plasterboard wall are capable of passing the force requirement of all major building codes reviewed. However it does not have the flexibility to obtain the full displacement requirement. The wall with Habito boards was found to have higher force capacity compared to the standard wall, but there was no significant increase in displacement capacity. The standard board with earthquake resistant inserts gives the additional flexibility required and was capable of taking up to 80 mm of displacement (with slot size=60 mm). However the load capacity of the wall gets reduced on account of this earthquake resistant insert, though it is above the force requirement.

In an alternate embodiment, a Habito board with earthquake resistant insert which will have high strength and required flexibility to maintain load capacity of the wall can be used.

The performance of Habito board wall with earthquake resistant inserts was done on a lab set-up of the wall and tested on a Universal Test Machine. This lab scale test set-up allowed a small segment of the wall system (dimension 0.25 m×0.25 m, with boards attached to metal frame inside) to be tested in in-plane shear (the critical factor which decides the performance of partition walls under earthquake loading) and was demonstrated to generate failure modes and other performance similar to a real wall system. Using the above set-up in a house, it was possible to do a scaled down and perform a parametric study of the seismic performance of wall systems.

Figure 10:
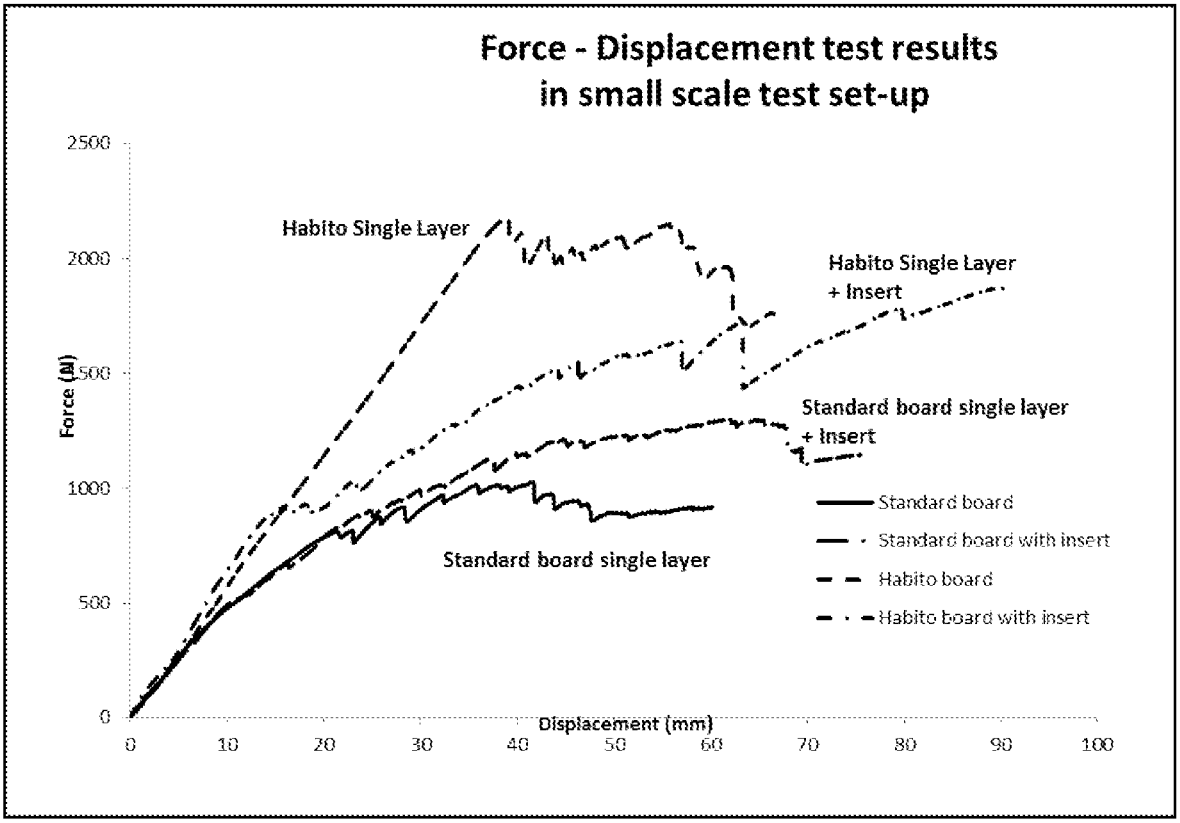
FIG. 10 illustrates a graph showing force vs displacement of standard plasterboard, standard plasterboard incorporated with earthquake resistant insert and a Habito board with earthquake resistant insert in a lab scale test step-up, according to an embodiment of the present disclosure.

Table 2 provides the results from the above test procedure. FIG. 10 illustrates force-displacement test results in a lab scale test set-up. The Habito board system with earthquake resistant inserts withstands higher displacement compared to a standard board (90 mm vs. 64 mm) combined with high strength (1900 N vs. 1300 N) and thus presented a "best solution" with optimal value of strength and flexibility.

TABLE 2

Results of Seismic Testing of Construction Boards - Lab Scale Set-up

| | Sample | | | |
|---|---|---|---|---|
| Parameters | Standard plasterboard, single layer | Standard plasterboard, single layer with earthquake resistant insert | Habito board, single layer | Standard plasterboard, single layer with earthquake resistant insert |
| Force (N) | 1000 | 1300 | 2150 | 1900+* |
| Displacement (mm) | 42 | 64 | 56 | 90+* |

*The test was stopped before achieving full system failure, due to limitations of the test set-up Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Certain features, that are for clarity, described herein in the context of separate embodiments, may also be provided in combination in a single embodiment. Conversely, various features that are, for brevity, described in the context of a single embodiment, may also be provided separately or in a sub combination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

The description in combination with the figures is provided to assist in understanding the teachings disclosed herein, is provided to assist in describing the teachings, and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent that certain details regarding specific materials and processing acts are not described, such details may include conventional approaches, which may be found in reference books and other sources within the manufacturing arts.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

LIST OF ELEMENTS

1 Runner
2 Insert
3 First fixing member
4 Adjacent surface
5 Elongate slot
6 Construction board
7 Second fixing member
8 Third fixing member
9 First runner
10 Floor surface
11 Second runner
12 Ceiling surface
13 Studs
14 Resistant members
15 Indent
100 Non-loadbearing wall
200 Method
210 Step
220 Step
230 Step
240 Step
250 Step
260 Step

What is claimed is:

1. An earthquake resistant wall construction, comprising;
a first runner;
a second runner;
one or more studs; and
at least one earthquake resistant insert provided within the first runner or the second runner;
wherein the earthquake resistant insert comprises at least one elongate slot and is held in communication with the first runner or second runner via at least one first fixing member which passes through the elongate slot,
wherein the studs are located substantially within the first runner and the second runner lying substantially adjacent to the at least one earthquake resistant insert and are disposed outside the at least one earthquake resistant insert, and
wherein the earthquake resistant insert is connected to a construction board on either side of the earthquake resistant insert via at least one second fixing member and wherein the construction boards are configured to move longitudinally along the length of the first and second runner concomitant with the movement of the earthquake resistant insert during an earthquake event.

2. The earthquake resistant wall construction of claim 1, wherein the first runner is provided on a floor and the second runner is provided on a ceiling.

3. The earthquake resistant wall construction of claim 1, wherein the long axis of the elongate slot lies substantially parallel to the longitudinal length of the first runner or the second runner and wherein the elongate slot has a width greater than the diameter of the first fixing member.

4. The earthquake resistant wall construction of claim 1, wherein the earthquake resistant insert has a shape that conforms to the shape of the corresponding runner and is located substantially within the first runner or second runner.

5. The earthquake resistant wall construction of claim 1, wherein the earthquake resistant insert extends beyond the sidewalls of the first runner or the second runner.

6. The earthquake resistant wall construction of claim 1, wherein the elongate slot comprises there within at least one resistant member perpendicular to the length of the first runner or the second runner.

7. The earthquake resistant wall construction of claim 1, further comprising at least one strut connected to the construction board, wherein the strut is located substantially within the first runner and the second runner lying substantially adjacent to the at least one earthquake resistant insert.

8. The earthquake resistant wall construction of claim 7 wherein the at least one strut comprises a wall stud.

9. The earthquake resistant wall construction of claim 1, further comprising at least one third fixing member which connects the first runner or the second runner to an adjacent surface, wherein the the third fixing member does not pass through the elongate slot of the earthquake resistant insert.

10. The earthquake resistant wall construction of claim 1, wherein the construction board comprises gypsum or cement or fibre cement.

11. The earthquake resistant wall construction of claim 1, wherein the first runner and the second runner can be spaced apart in a horizontal plane.

12. The earthquake resistant wall construction of claim 1, wherein, the earthquake resistant insert comprises:

a base; and a first leg and a second leg, each of the first leg and the second leg extending perpendicularly from the base, wherein the base comprises the at least one elongate slot accommodating the at least one first fixing member.

13. The earthquake resistant wall construction of claim 12, wherein the first leg and the second leg have a height greater than that of the first and second runners and wherein the first leg and the second leg are connected to the construction board on either sides by the at least one second fixing member.

14. The earthquake resistant wall construction of claim 12, wherein the long axis of the elongate slot lies substantially parallel to the longitudinal length of the runner and wherein the elongate slot has a width greater than the diameter of the first fixing member.

15. The earthquake resistant wall construction of claim 12, wherein the elongate slot further comprises therewithin at least one resistant member perpendicular to the length of the first runner or second runner.

16. The earthquake resistant wall construction of claim 15, wherein the resistant member has at least one indent along its length.

17. The earthquake resistant wall construction of claim 12, comprising a textured surface.

18. A method of constructing an earthquake resistant wall construction according to claim 1, the method comprising:

providing the first runner and the second runner;

fixing the first and second runner to an adjacent surface using at least one third fixing member;

sliding one or more studs to the runners by placing one end of the stud into the first runner and the other end of the stud into the second runner;

placing the earthquake resistant insert between the studs in the first runner and/ or the second runner, fixing the earthquake resistant insert to the first or second runner through the first fixing member; and attaching a construction board on either side of the earthquake resistant insert via at least one second fixing member.

19. The method of claim 18, wherein the construction boards are not held in a fixed position relative to the first runner and the second runner and are configured to move longitudinally along the length of the first runner and the second runner concomitant with the movement of the earthquake resistant insert during an earthquake event.

* * * * *